US012798837B2

(12) United States Patent
Kim

(10) Patent No.: US 12,798,837 B2
(45) Date of Patent: Nov. 17, 2026

(54) CLOSURE WITH MODIFIED RETAINING BAND

(71) Applicant: Silgan White Cap LLC, Downers Grove, IL (US)

(72) Inventor: Sungsuk Steve Kim, Batavia, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 19/040,346

(22) Filed: Jan. 29, 2025

(65) Prior Publication Data

US 2025/0236439 A1 Jul. 24, 2025

Related U.S. Application Data

(63) Continuation of application No. PCT/US2025/012422, filed on Jan. 21, 2025.

(60) Provisional application No. 63/623,563, filed on Jan. 22, 2024.

(51) Int. Cl.
*B65D 41/34* (2006.01)
*B65D 41/32* (2006.01)

(52) U.S. Cl.
CPC ..... *B65D 41/3447* (2013.01); *B65D 41/325* (2013.01); *B65D 2251/20* (2013.01); *B65D 2401/20* (2020.05)

(58) Field of Classification Search
CPC ..... B65D 41/3447; B65D 41/325; B65D 2251/20; B65D 2401/20; B65D 55/16
USPC ..... 215/252
See application file for complete search history.

(56) References Cited

U.S. PATENT DOCUMENTS

| | | | |
|---|---|---|---|
| 4,546,892 | A | 10/1985 | Couput |
| 4,801,030 | A | 1/1989 | Barriac |
| 4,981,230 | A | 1/1991 | Marshall et al. |
| 5,007,545 | A | 4/1991 | Imbery, Jr. |
| 5,058,755 | A | 10/1991 | Hayes |
| 5,080,246 | A | 1/1992 | Hayes |

(Continued)

FOREIGN PATENT DOCUMENTS

| | | |
|---|---|---|
| CN | 1541175 | 10/2004 |
| DE | 202004015939 | 12/2004 |

(Continued)

OTHER PUBLICATIONS

International Search Report and Written Opinion for International Application No. PCT/US2025/012422, dated Apr. 24, 2025, 13 pages.

*Primary Examiner* — James N Smalley
(74) *Attorney, Agent, or Firm* — Reinhart Boerner Van Deuren s.c.

(57) ABSTRACT

A closure with a top panel, a skirt extending downward and away from the top panel, frangible connections that connect the skirt to a tamper band. The frangible connections provide a visual indication, when broken, that the closure has been opened. The tamper band includes a sidewall coupled to the frangible connections, and a container engagement structure that extends from the tamper band and interfaces with the container neck when the closure is opened for the first time. The engagement end includes a first portion that defines an end surface facing away from the connection point, and a second portion that extends past the first portion and is further from the vertical axis than the first portion.

14 Claims, 6 Drawing Sheets

(56) References Cited

U.S. PATENT DOCUMENTS

| | | | | |
|---|---|---|---|---|
| 5,660,290 | A | 8/1997 | Hayes | |
| 6,119,883 | A | 9/2000 | Hock et al. | |
| 6,673,298 | B2 | 1/2004 | Krueger | |
| 7,344,039 | B2 | 3/2008 | Bixler et al. | |
| 8,231,018 | B2 | 7/2012 | Gassner | |
| 2002/0066713 | A1 † | 6/2002 | Ma | |
| 2002/0079618 | A1 | 6/2002 | Krueger | |
| 2003/0098285 | A1 | 5/2003 | Gregory et al. | |
| 2005/0189312 | A1 | 9/2005 | Bixler et al. | |
| 2006/0283828 | A1 * | 12/2006 | Falzoni | B65D 41/3428 215/200 |
| 2007/0090080 | A1 | 4/2007 | Lohrman et al. | |
| 2007/0251911 | A1 | 11/2007 | Russell | |
| 2009/0057261 | A1 | 3/2009 | Ma et al. | |
| 2010/0032402 | A1 | 2/2010 | Widmer et al. | |
| 2015/0129534 | A1 † | 5/2015 | Falzoni | |
| 2019/0337691 | A1 * | 11/2019 | Kim | B65D 41/325 |

FOREIGN PATENT DOCUMENTS

| | | |
|---|---|---|
| DE | 102007005595 | 8/2007 |
| DE | 102007005594 | 8/2008 |
| JP | 2001-72102 | 3/2001 |
| WO | WO83/03809 | 11/1983 |
| WO | WO2005/067588 | 7/2005 |
| WO | WO2022/066555 | 3/2022 |

* cited by examiner
† cited by third party

CLOSURE WITH MODIFIED RETAINING BAND

CROSS-REFERENCE TO RELATED PATENT APPLICATIONS

The present application is a continuation of International Application No. PCT/US2025/012422, filed Jan. 21, 2025, which claims the benefit of and priority to U.S. Provisional Application No. 63/623,563, filed on Jan. 22, 2024, each of which is incorporated herein by reference in its entirety.

BACKGROUND OF THE INVENTION

The present disclosure relates generally to closures, and in particular to closures with a tamper band to evidence when the closure has been removed. This disclosure describes closures with a container engagement structure having an improved structure that engages the container neck when the closure is opened for the first time.

SUMMARY OF THE INVENTION

According to an embodiment of the invention, a closure includes a generally circular top panel centered about a vertical axis and an outer periphery, a skirt extending downward and away from the outer periphery of the top panel, the skirt including a first inner surface, a thread formed about the first inner surface of the skirt, the thread configured to engage with a container neck, frangible connections that provide a visual indication, when broken, that the closure has been opened, and a tamper band that decouples from the skirt after the frangible connections are broken. The tamper band includes a sidewall coupled to the frangible connections, a connection point extending from the sidewall, a container engagement structure pivotably coupled to the sidewall via the connection point, and a plurality of apertures extending through the container engagement structure. The container engagement structure engages with the container neck when the closure is opened for the first time to break the frangible connections. The container engagement structure extends from the connection point. The container engagement structure includes a first portion that defines an end surface facing away from the connection point that engages against the container neck when the closure is opened for the first time, and the container engagement structure further includes a second portion extending further from the connection point than the first portion. None of the second portions that extend further from the connection point than the first portions are above any of the plurality of apertures.

According to another embodiment of the invention, a closure includes a generally circular top panel centered about a vertical axis and including an outer periphery, a skirt extending downward and away from the outer periphery of the top panel, the skirt including a first inner surface, a thread formed about the first inner surface of the skirt, the thread configured to engage with a container neck, frangible connections that provide a visual indication, when broken, that the closure has been opened, and a tamper band that decouples from the skirt after the frangible connections are broken. The tamper band includes a sidewall coupled to the frangible connections, a connection point extending from the sidewall, a container engagement structure pivotably coupled to the sidewall via the connection point, and a plurality of apertures extending through the container engagement structure. The container engagement structure engages with the container neck when the closure is opened for the first time to break the frangible connections. The container engagement structure extends from the connection point. The container engagement structure includes a first portion that defines an end surface facing away from the connection point that engages against the container neck when the closure is opened for the first time, and the container engagement structure further includes a second portion defining a second inner surface that faces towards the vertical axis. The second inner surfaces interface with container neck when the end surface engages against the container neck when the closure is opened for the first time. None of the second inner surfaces that interface with the container neck are above any of the plurality of apertures.

According to another embodiment of the invention, a closure includes a generally circular top panel centered about a vertical axis and including an outer periphery, a skirt extending downward and away from the outer periphery of the top panel, the skirt including a first inner surface, a thread formed about the first inner surface of the skirt, the thread configured to engage with a container neck, frangible connections that provide a visual indication, when broken, that the closure has been opened, and a tamper band that decouples from the skirt after the frangible connections are broken. The tamper band includes a sidewall coupled to the frangible connections, a connection point extending from the sidewall, a container engagement structure pivotably coupled to the sidewall via the connection point, a plurality of apertures extending through the container engagement structure. The container engagement structure engages with the container neck when the closure is opened for the first time to break the frangible connections. The container engagement structure extends from the connection point. The container engagement structure includes a first portion that defines an end surface facing away from the connection point that engages against the container neck when the closure is opened for the first time, and the container engagement structure further includes a second portion extending further from the connection point than the first portion. None of the second portions that extend further from the connection point than the first portions are directly between any of the plurality of apertures and the top panel.

Additional features and advantages will be set forth in the detailed description which follows, and will be readily apparent to those skilled in the art from the description or recognized by practicing the embodiments as described in the written description and/or shown in the accompany drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments. In addition, alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

This disclosure provides a description for various embodiments of a closure with a container engagement structure that provides an improved interaction with the container neck when the closure is opened for the first time. In various embodiments, the container engagement structure includes a first portion having an end that interfaces with the container neck, and a second portion that extends past the first portion, the second portion having an inner surface that interfaces with the container neck. The container engagement structure further includes sections that extend further from the central axis of the closure. Applicant has observed that providing a container engagement structure with the container engagement structure(s) described herein interfaces with the container neck more securely compared to other container engagement structures.

Figure 1:
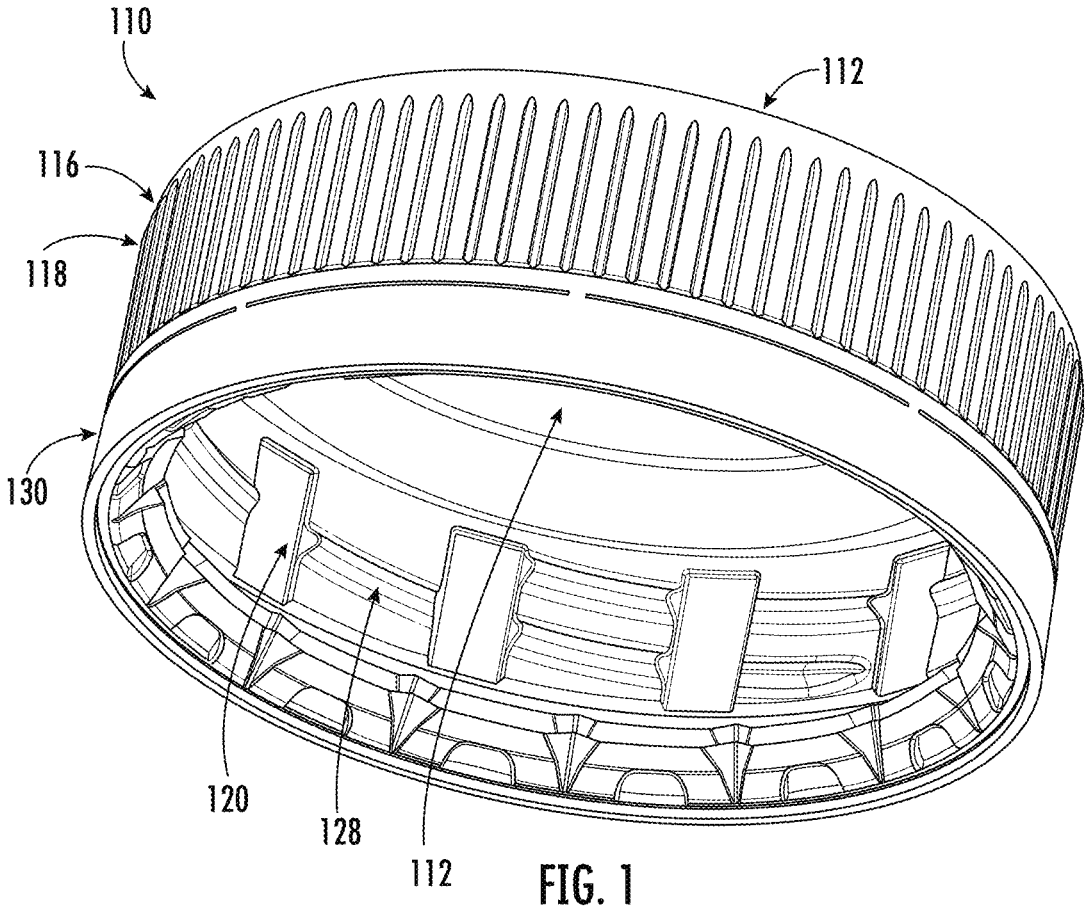
FIG. 1 is a perspective view of a closure, according to an exemplary embodiment.
Figure 2:
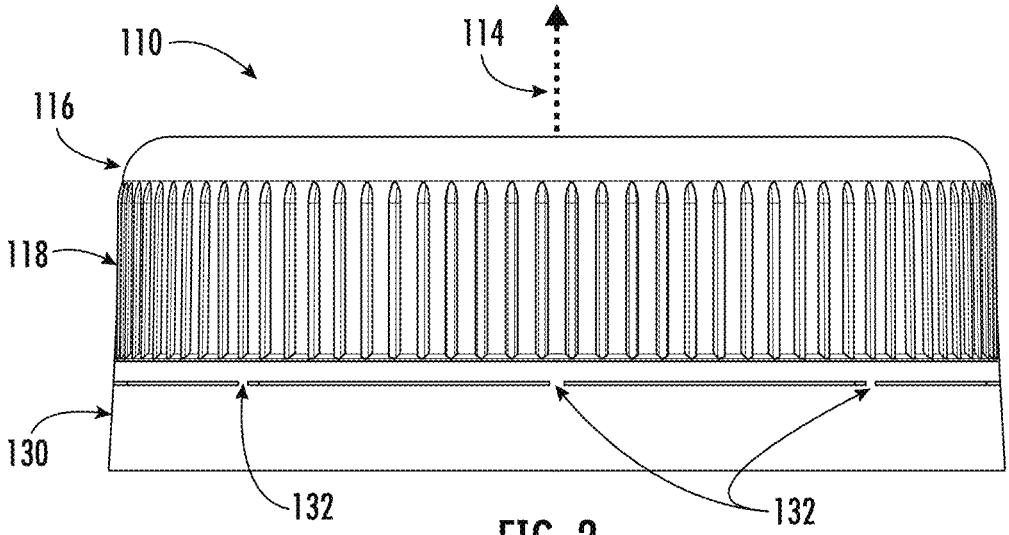
FIG. 2 is a front view of the closure of FIG. 1, according to an exemplary embodiment.
Figure 3:
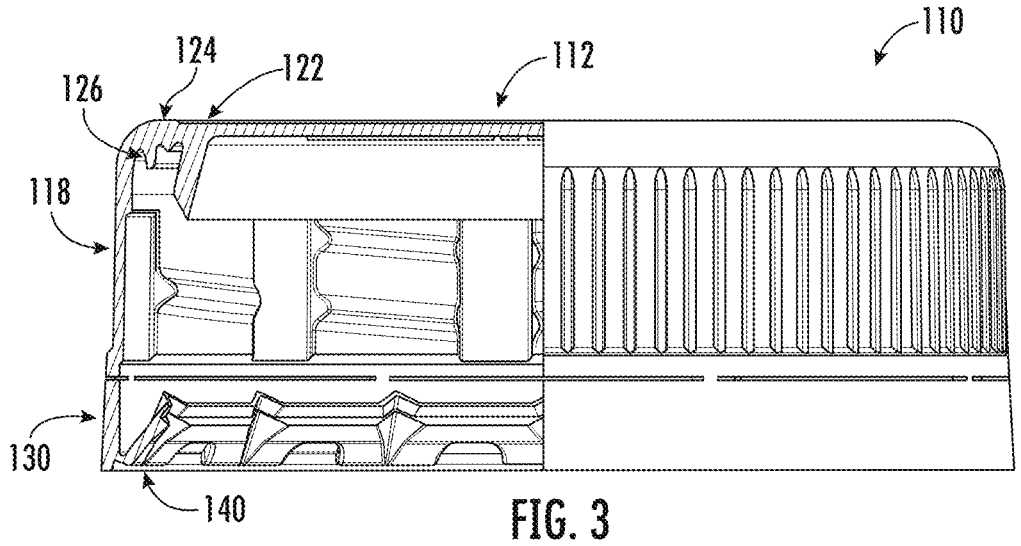
FIG. 3 is a front view of the closure of FIG. 1 with a portion of the closure removed, according to an exemplary embodiment.
Figure 4:
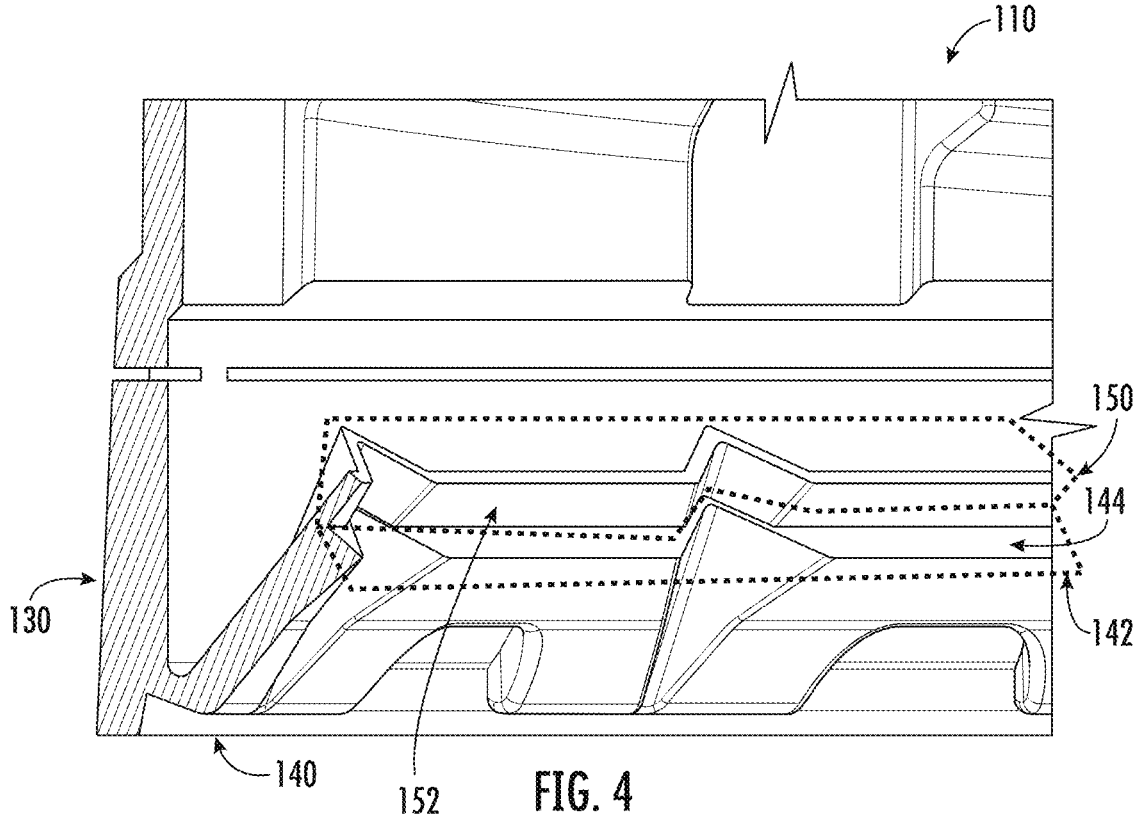
FIG. 4 is a detailed partial cross-section view of the closure of FIG. 3, according to an exemplary embodiment.
Figure 5:
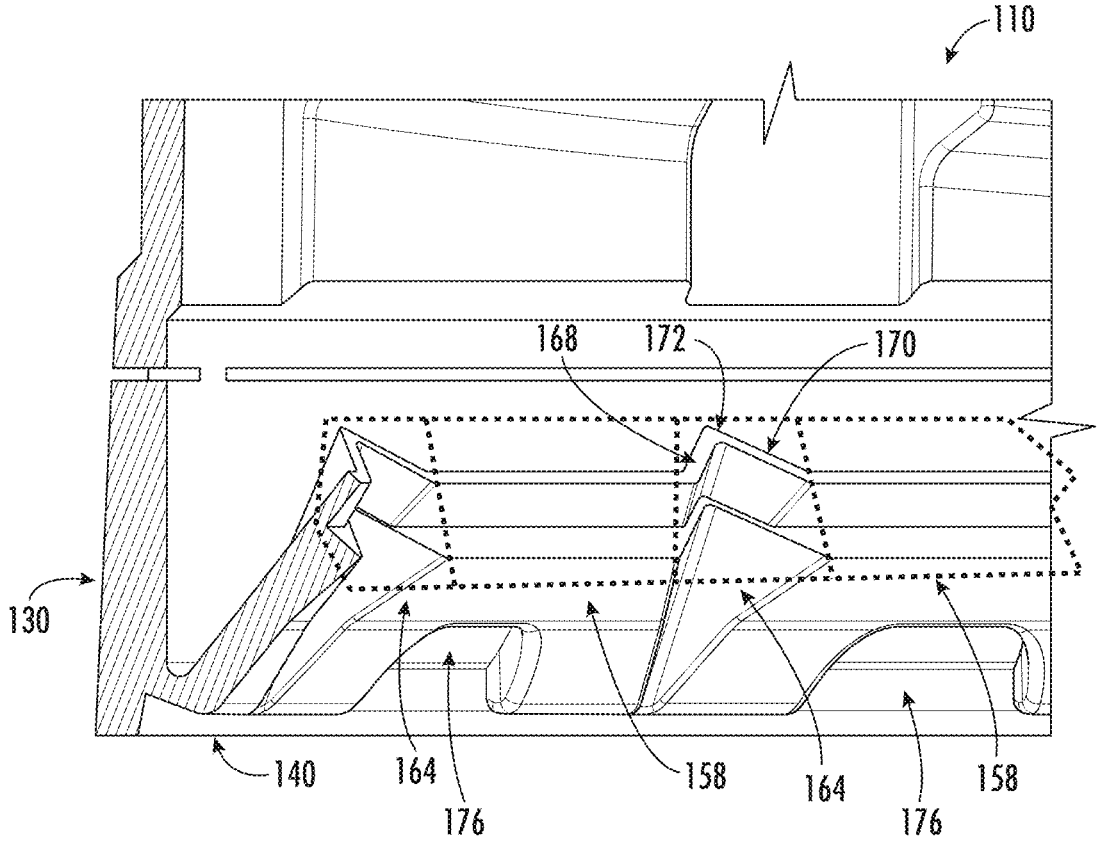
FIG. 5 is a detailed partial cross-section view of the closure of FIG. 3, according to an exemplary embodiment.

Turning to FIGS. 1-2, a closure 110 is provided. The closure 110 includes a top panel 112 generally centered on axis 114. Skirt 118 extends downward from periphery 116 of top panel 112 to a tamper band 130. Skirt 118 defines an inner surface 120 facing towards axis 114, and inner surface 120 includes thread 128. Thread 128 is configured to detachably engage with a container neck (e.g., container neck 192 of container 190).

A plurality of frangible connections 132 connect skirt 118 and tamper band 130 before closure 110 is opened for the first time. After closure 110 is opened for the first time, frangible connections 132 are broken, thereby separating skirt 118 and tamper band 130.

Referring to FIGS. 3-7, various aspects of closure 110 are shown. Closure 110 includes first plug 122, second plug 124, and third plug 126 extending downward from top panel 112. Second plug 124 is radially further from axis 114 than first plug 122, and third plug 126 is radially further from axis 114 than each of first plug 122 and second plug 124.

In a specific embodiment, closure 110 includes a generally annular first plug 122 extending downwards from the lower surface of the top panel 112, the first plug 122 being located radially inwards relative to the outer periphery 116 of the top panel 112. In a specific embodiment, closure 110 includes a generally annular second plug 124 extending downwards from the lower surface of the top panel 112, the second plug 124 being located radially between the first plug 122 and the outer periphery 116 of the top panel 112, the first plug 122 extending downward further than the second plug 124. In a specific embodiment, closure 110 includes a generally annular third plug 126 extending downwards from the lower surface of the top panel 112, the third plug 126 being located radially between the second plug 124 and the outer periphery 116 of the top panel 112, the third plug 126 extending further than the second plug 124 and the first plug 122 extending further than the third plug 126.

Closure 110 includes container engagement structure 140 that engages with a container neck to break frangible connections 132 the first time that closure 110 is opened. Container engagement structure 140 extends from the tamper band 130 to an engagement end including a first portion 142 that defines an end surface 144 that engages against the container neck 192 to break the frangible connections when the closure 110 is opened for the first time, and the engagement end further includes a second portion 150 further from the vertical axis 114 than the first portion 142. Second portion 150 extends further from the connection point than the first portion 142, the engagement end including first sections 158 that are a first distance from the vertical axis 114, and second sections 164 that are a second distance from the vertical axis 114 that is further than the first distance.

In various embodiments, one or more of the second sections 164 defines a V-shape including a first side 168 that extends linearly both away from the vertical axis 114 and circumferentially around the vertical axis 114, and a second side 170 that extends linearly both away from the vertical axis 114 and circumferentially around the vertical axis 114. In various embodiments, the first side 168 and the second side 170 intersect at a peak 172 that is portion of the respective second section 164 that is the furthest from the vertical axis 114. In various embodiments, the first side 168 and the second side 170 intersect at a peak 172 that is a portion of the respective second section 164 that is the furthest from the vertical axis 114.

In various embodiments, container engagement structure 140 includes a plurality of apertures 176 that provide fluid communication through the container engagement structure 140.

Figure 6:
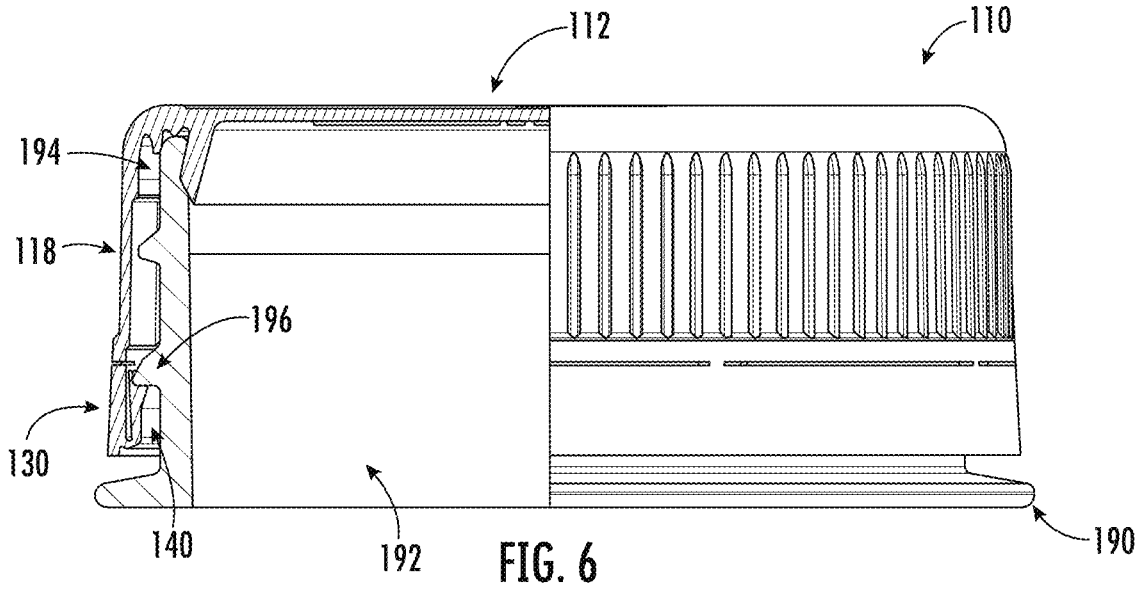
FIG. 6 is a front view of the closure of FIG. 1 affixed to a container with a portion of the closure removed, according to an exemplary embodiment.
Figure 7:
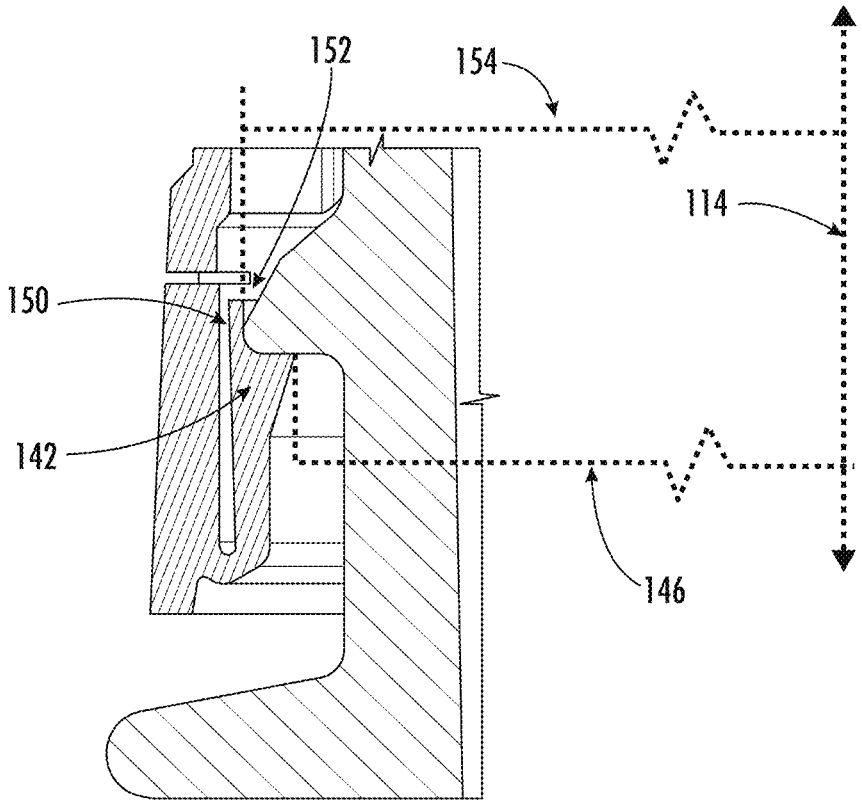
FIG. 7 is a detailed partial cross-section view of the closure of FIG. 6 affixed to a container, according to an exemplary embodiment.

Referring to FIGS. 6-7, container engagement structure 140 interfaces with projection 196 extending outward from outer surface 194 of container neck 192 of container 190. First portion 142 is, at its shortest point, distance 146 from axis 114, and inner surface 152 of second portion 150 is, at its shortest point, distance 154 from axis, and distance 154 is more than distance 146 when closure 110 is applied to a container neck 192 for the first time.

Figure 8:
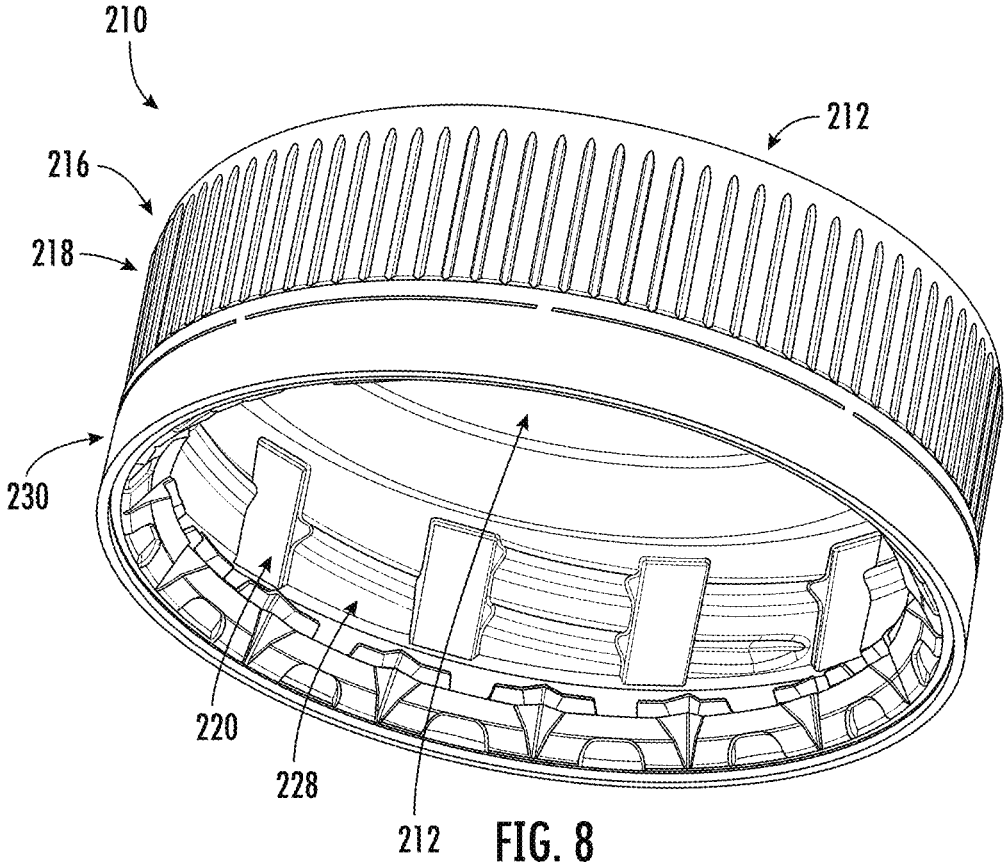
FIG. 8 is a perspective view of a closure, according to an exemplary embodiment.
Figure 9:
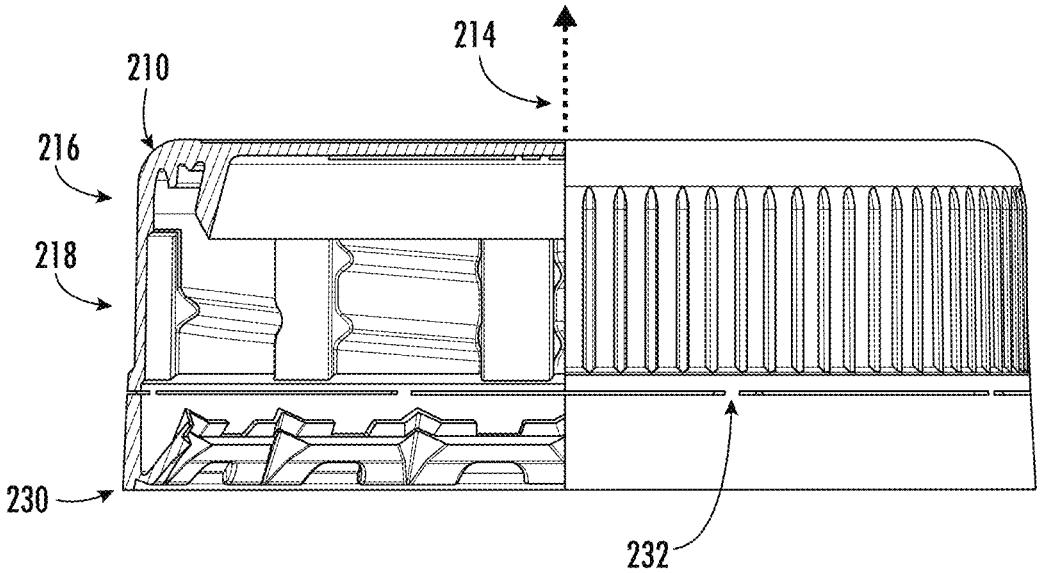
FIG. 9 is a front view of the closure of FIG. 8 with a portion of the closure removed, according to an exemplary embodiment.
Figure 10:
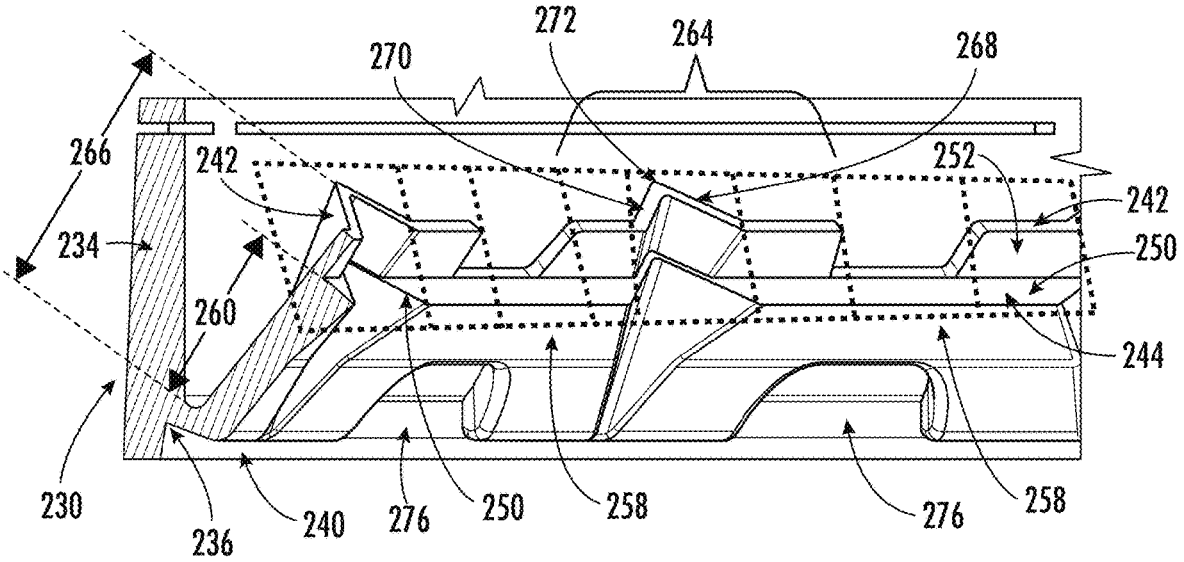
FIG. 10 is a detailed partial cross-section view of the closure of FIG. 9, according to an exemplary embodiment.

Referring to FIGS. 8-10, various aspects of closure 210 are provided. Closure 210 is structurally and functionally similar to closure 110 except as otherwise described.

Closure 210 includes a generally circular top panel 212 centered about a vertical axis 214 and an outer periphery 216, a skirt 218 extending downward and away from the outer periphery 216 of the top panel 212, the skirt 218 including a first inner surface 220, a thread 228 formed about the first inner surface 220 of the skirt 218, the thread 228 configured to engage with a container neck (e.g., container neck 192 of container 190), frangible connections 232 that provide a visual indication, when broken, that the closure 210 has been opened, and a tamper band 230 that decouples from the skirt 218 after the frangible connections 232 are broken.

A plurality of frangible connections 232 connect skirt 218 and tamper band 230 before closure 210 is opened for the first time. After closure 210 is opened for the first time, frangible connections 232 are broken, thereby separating skirt 218 and tamper band 230.

Tamper band 230 includes a sidewall 234 coupled to the frangible connections 232, a connection point 236 extending from the sidewall 234, a container engagement structure 240 pivotably coupled to the sidewall 234 via the connection point 236, and a plurality of apertures 276 extending through the container engagement structure 240.

Container engagement structure 240 engages with the container neck when the closure 210 is opened for the first time to break the frangible connections 232. Container engagement structure 240 extends from the connection point 236. Container engagement structure 240 includes a first portion 242 that defines an end surface 244 facing away from the connection point 236 that engages against the container neck when the closure 210 is opened for the first time. Container engagement structure 240 further includes a second portion 250 extending further from the connection point 236 than the first portion 242.

In various embodiments, none of the second portions 250 that extend further from the connection point 236 than the first portions 242 are above any of the plurality of apertures 276. In various embodiments, none of the second portions 250 that extend further from the connection point 236 than the first portions 242 are directly between any of the plurality of apertures 276 and the top panel 212.

In various embodiments, container engagement structure 240 includes first sections 258 in which the second portion 250 extends a first distance 260 from the connection point 236, and second sections 264 in which the second portion 250 extends a second distance 266 from the connection point 236 that is more than the first distance 260. In various embodiments, in the first sections 258, the first portion 242 extends at least as far from the connection point 236 as the second portion 250.

In various embodiments, one or more of the second sections 264 define a V-shape peak 272 includes a first side 268 that extends linearly both away from the vertical axis 214 and circumferentially around the vertical axis 214, and a second side 270 that extends linearly both away from the vertical axis 214 and circumferentially around the vertical axis 214. The first side 268 and the second side 270 intersect at a peak 272 that is the portion of the respective second section 264 that is the furthest from the vertical axis 214. In various embodiments, none of the V-shaped peaks 272 are above any of the plurality of apertures 276. In various embodiments, at least one V-shaped peak 272 is circumferentially between each of each two neighboring plurality of apertures 276.

In various embodiments, the second portion 250 is closer to the sidewall 234 of the tamper band 230 than the first portion 242. In various embodiments, the second portion 250 is configured to interface against the sidewall 234 of the tamper band 230 when the closure 210 is being applied to a container.

In various embodiments, the second sections 264 of the second portion 250 of the container engagement structure 240 define a second inner surface 252 that faces towards the vertical axis 214. The second inner surfaces 252 interface with container neck when the end surface 244 engages against the container neck when the closure 210 is opened for the first time. In various embodiments, none of the second inner surfaces 252 that interface with the container neck are above any of the plurality of apertures 276.

In various embodiments, similar to closure 110, closure 210 includes a generally annular first plug (such as first plug 122 of closure 110) extending downwards from the lower surface of the top panel 212, the first plug being located radially inwards relative to the outer periphery 216 of the top panel 212.

In various embodiments, similar to closure 110, closure 210 includes a generally annular second plug (such as second plug 124 of closure 110) extending downwards from the lower surface of the top panel 212, the second plug being located radially between the first plug and the outer periphery 216 of the top panel 212, the first plug extending downward further than the second plug.

In various embodiments, similar to closure 110, closure 210 includes a generally annular third plug (such as third plug 126 of closure 110) extending downwards from the lower surface of the top panel 212, the third plug being located radially between the second plug and the outer periphery 216 of the top panel 212, the third plug extending further than the second plug and the first plug extending further than the third plug.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature. As used herein, "rigidly coupled" refers to two components being coupled in a manner such that the components move together in a fixed positional relationship when acted upon by a force.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A closure comprising:

a generally circular top panel centered about a vertical axis and an outer periphery;

a skirt extending downward and away from the outer periphery of the top panel, the skirt comprising a first inner surface;

a thread formed about the first inner surface of the skirt, the thread configured to engage with a container neck;

frangible connections that provide a visual indication, when broken, that the closure has been opened; and a tamper band that decouples from the skirt after the frangible connections are broken, the tamper band comprising:

a sidewall coupled to the frangible connections;

a connection point extending from the sidewall;

a container engagement structure pivotably coupled to the sidewall via the connection point, the container engagement structure engaging with the container neck when the closure is opened for the first time to break the frangible connections, the container engagement structure extending from the connection point, the container engagement structure comprising a first portion that defines an end surface facing away from the connection point that engages against the container neck when the closure is opened for the first time, and the container engagement structure further comprising a second portion extending further from the connection point than the first portion, the container engagement structure comprising first sections in which the second portion extends a first distance from the connection point, and second sections in which the second portion extends a second distance from the connection point that is more than the first distance, wherein, in the first sections, the first portion extends at least as far from the connection point as the second portion; and a plurality of apertures extending through the container engagement structure, wherein none of the second portions that extend further from the connection point than the first portions are above any of the plurality of apertures.

2. A closure comprising:

a generally circular top panel centered about a vertical axis and an outer periphery;

a skirt extending downward and away from the outer periphery of the top panel, the skirt comprising a first inner surface;

a thread formed about the first inner surface of the skirt, the thread configured to engage with a container neck;

frangible connections that provide a visual indication, when broken, that the closure has been opened; and a tamper band that decouples from the skirt after the frangible connections are broken, the tamper band comprising:

a sidewall coupled to the frangible connections;

a connection point extending from the sidewall;

a container engagement structure pivotably coupled to the sidewall via the connection point, the container engagement structure engaging with the container neck when the closure is opened for the first time to break the frangible connections, the container engagement structure extending from the connection point, the container engagement structure comprising a first portion that defines an end surface facing away from the connection point that engages against the container neck when the closure is opened for the first time, and the container engagement structure further comprising a second portion extending further from the connection point than the first portion, the container engagement structure comprising first sections in which the second portion extends a first distance from the connection point, and second sections in which the second portion extends a second distance from the connection point that is more than the first distance, wherein the second sections of the second portion of the container engagement structure define a second inner surface that faces towards the vertical axis, and wherein the second inner surfaces interface with the container neck when the end surface engages against the container neck when the closure is opened for the first time; and a plurality of apertures extending through the container engagement structure, wherein none of the second portions that extend further from the connection point than the first portions are above any of the plurality of apertures.

3. A closure comprising:

a generally circular top panel centered about a vertical axis and an outer periphery;

a skirt extending downward and away from the outer periphery of the top panel, the skirt comprising a first inner surface;

a thread formed about the first inner surface of the skirt, the thread configured to engage with a container neck;

frangible connections that provide a visual indication, when broken, that the closure has been opened; and a tamper band that decouples from the skirt after the frangible connections are broken, the tamper band comprising:

a sidewall coupled to the frangible connections;

a connection point extending from the sidewall;

a container engagement structure pivotably coupled to the sidewall via the connection point, the container engagement structure engaging with the container neck when the closure is opened for the first time to break the frangible connections, the container engagement structure extending from the connection point, the container engagement structure comprising a first portion that defines an end surface facing away from the connection point that engages against the container neck when the closure is opened for the first time, and the container engagement structure further comprising a second portion extending further from the connection point than the first portion, the container engagement structure comprising first sections in which the second portion extends a first distance from the connection point, and second sections in which the second portion extends a second distance from the connection point that is more than the first distance, wherein one or more of the second sections define a V-shape peak comprising a first side that extends linearly both away from the vertical axis and circumferentially around the vertical axis, and a second side that extends linearly both away from the vertical axis and circumferentially around the vertical axis; and a plurality of apertures extending through the container engagement structure, wherein none of the second portions that extend further from the connection point than the first portions are above any of the plurality of apertures.

4. The closure of claim 3, wherein the first side and the second side intersect at a peak that is the portion of the respective second section that is the furthest from the vertical axis.

5. The closure of claim 3, wherein none of the V-shaped peaks are above any of the plurality of apertures.

6. The closure of claim 3, wherein at least one V-shaped peak is circumferentially between each of the plurality of apertures.

7. The closure of claim 1, wherein the second portion is closer to the sidewall of the tamper band than the first portion.

8. The closure of claim 1, wherein the second portion is configured to interface against the sidewall of the tamper band when the closure is being applied to a container.

9. The closure of claim 1, the closure further comprising:

a generally annular first plug extending downwards from the lower surface of the top panel, the first plug being located radially inwards relative to the outer periphery of the top panel; and a generally annular second plug extending downwards from the lower surface of the top panel, the second plug being located radially between the first plug and the outer periphery of the top panel, the first plug extending downward further than the second plug.

10. The closure of claim 9, the closure further comprising:

a generally annular third plug extending downwards from the lower surface of the top panel, the third plug being located radially between the second plug and the outer periphery of the top panel, the third plug extending further than the second plug and the first plug extending further than the third plug.

11. A closure comprising:

a generally circular top panel centered about a vertical axis and comprising an outer periphery;

a skirt extending downward and away from the outer periphery of the top panel, the skirt comprising a first inner surface;

a thread formed about the first inner surface of the skirt, the thread configured to engage with a container neck;

frangible connections that provide a visual indication, when broken, that the closure has been opened; and a tamper band that decouples from the skirt after the frangible connections are broken, the tamper band comprising:

a sidewall coupled to the frangible connections;

a connection point extending from the sidewall;

a container engagement structure pivotably coupled to the sidewall via the connection point, the container engagement structure engaging with the container neck when the closure is opened for the first time to break the frangible connections, the container engagement structure extending from the connection point, the container engagement structure comprising a first portion that defines an end surface facing away from the connection point that engages against the container neck when the closure is opened for the first time, and the container engagement structure further comprising a second portion defining a plurality of second inner surfaces that face towards the vertical axis, the container engagement structure comprising first sections in which the second portion extends a first distance from the connection point, and second sections in which the second portion extends a second distance from the connection point that is more than the first distance, wherein, in the first sections, the first portion extends at least as far from the connection point as the second portion, wherein the plurality of second inner surfaces interface with the container neck when the end surface engages against the container neck when the closure is opened for the first time; and a plurality of apertures extending through the container engagement structure, wherein none of the plurality of second inner surfaces that interface with the container neck are above any of the plurality of apertures.

12. The closure of claim 11, wherein the second portion is closer to the sidewall of the tamper band than the first portion.

13. A closure comprising:

a generally circular top panel centered about a vertical axis and comprising an outer periphery;

a skirt extending downward and away from the outer periphery of the top panel, the skirt comprising a first inner surface;

a thread formed about the first inner surface of the skirt, the thread configured to engage with a container neck;

frangible connections that provide a visual indication, when broken, that the closure has been opened; and a tamper band that decouples from the skirt after the frangible connections are broken, the tamper band comprising:

a sidewall coupled to the frangible connections;

a connection point extending from the sidewall;

a container engagement structure pivotably coupled to the sidewall via the connection point, the container engagement structure engaging with the container neck when the closure is opened for the first time to break the frangible connections, the container engagement structure extending from the connection point, the container engagement structure comprising a first portion that defines an end surface facing away from the connection point that engages against the container neck when the closure is opened for the first time, and the container engagement structure further comprising a second portion extending further from the connection point than the first portion, the container engagement structure comprising first sections in which the second portion extends a first distance from the connection point, and second sections in which the second portion extends a second distance from the connection point that is more than the first distance, wherein, in the first sections, the first portion extends at least as far from the connection point as the second portion; and a plurality of apertures extending through the container engagement structure, wherein none of the second portions that extend further from the connection point than the first portions are directly between any of the plurality of apertures and the top panel.

14. The closure of claim 13, wherein the second portion is closer to the sidewall of the tamper band than the first portion.

* * * * *